United States Patent [19]

Corrigan

[11] 4,229,913

[45] Oct. 28, 1980

[54] CEILING DISPLAY

[75] Inventor: James L. Corrigan, Lancaster, Pa.

[73] Assignee: Armstrong Cork Company, Lancaster, Pa.

[21] Appl. No.: 69,549

[22] Filed: Aug. 24, 1979

[51] Int. Cl.[3] ..... E04B 5/52; E04F 19/02

[52] U.S. Cl. ..... 52/38; 40/617; 52/39; 52/27; 52/484

[58] Field of Search ..... 52/27, 38, 39, 105, 52/484; 40/607, 617

[56] References Cited

U.S. PATENT DOCUMENTS

| | | | |
|---|---|---|---|
| 2,928,197 | 3/1960 | Zuckerman | 40/617 X |
| 2,991,577 | 7/1961 | Bellocchio | 40/152.1 |
| 3,084,401 | 4/1963 | Findlay . | |
| 3,181,274 | 5/1965 | Izenowi | 52/484 X |
| 3,343,310 | 9/1967 | Netz et al. | 52/28 |
| 3,374,596 | 3/1968 | O'Brien et al. | 52/664 |
| 3,511,012 | 5/1970 | Brady | 52/667 |
| 3,668,826 | 6/1972 | White et al. | 52/28 |
| 3,685,238 | 8/1972 | Fisher et al. | 52/484 X |
| 3,862,523 | 1/1975 | Eaton | 52/27 |
| 3,918,234 | 11/1975 | Weissman | 52/39 |
| 4,081,931 | 4/1978 | Miyoshi | 52/39 |

FOREIGN PATENT DOCUMENTS

| | | | |
|---|---|---|---|
| 1566958 | 3/1969 | France | 40/617 |

*Primary Examiner*—Alfred C. Perham

[57] ABSTRACT

A display for ceiling boards is fabricated to provide consumers with an indication of the different ceiling board designs which are available for purchase. The display is suspended at an inclined relationship for the purpose of displaying the different ceiling designs in a simulated suspended ceiling arrangement. Divider means are provided between adjacent ceiling designs to segregate the different designs and to more clearly simulate a room display for each design.

5 Claims, 2 Drawing Figures

CEILING DISPLAY

BACKGROUND OF THE INVENTION

1. Field of the Invention

The invention is directed to a display element and, more particularly, to a display element for ceiling boards.

2. Description of the Prior Art

It is old to provide a suspended ceiling display for ceiling boards of different designs. A plurality of T-shaped runner members are usually formed into a grid pattern and the runners have flanges which are adapted to support ceiling boards. A plurality of ceiling boards with different designs on the face thereof are positioned on the flanges of the runners. The runners and ceiling boards are suspended from the structural members of a building and are normally positioned about 7 to 14 feet above the floor of the building. The plane of the faces of the ceiling boards having the different designs are inclined slightly from the vertical so that the ceiling board faces can be viewed by the prospective purchaser directly on from the floor of the building.

The invention herein is the use of divider means between the different ceiling designs for the purpose of segregating the designs and creating a situation which more closely simulates the use of the ceiling designs in a room configuration.

SUMMARY OF THE INVENTION

The invention is directed to a ceiling display unit which comprises a pluraliy of T-shaped runner members formed into a grid pattern with the runner members having flanges adapted to support ceiling boards. A plurality of ceiling boards with different designs on the faces thereof are positioned on the runners arranged in the grid pattern. The runners and ceiling boards are suspended from the structural members of a building and positioned about 7 to 14 feet above the floor of the building. The plane of the faces of the ceiling boards having the different designs is inclined slightly from the vertical so that ceiling boards can be viewed directly on by a person standing on the floor of the building. The ceiling display has a plurality of divider means positioned perpendicular to the plane of the faces of the ceiling boards. The divider means separates the different ceiling board designs one from the other. Thus, the individual designs are segregated and due to the arrangement of the dividers, create an appearance of a simulated room usage for the individual designs.

DESCRIPTION OF THE PREFERRED EMBODIMENTS

Figure 2:
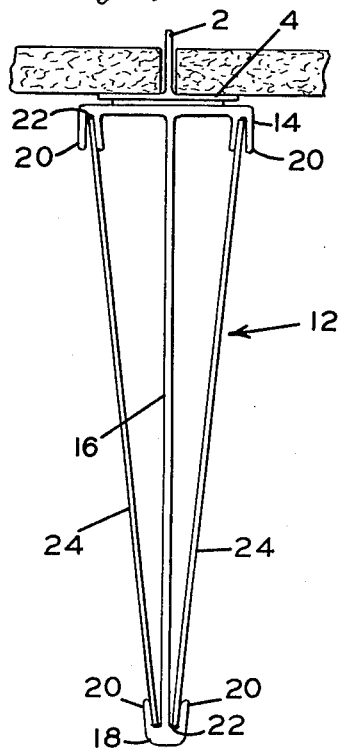
FIG. 2 is a cross-sectional view of the divider means in use.

A conventional ceiling displays unit would comprise a plurality of inverted T-shape runner members 2 arranged in a grid pattern. The runners will have flanges 4 as shown in FIG. 2. The runners are arranged in a grid pattern with at least an upper runner 3 and a lower runner 5 extending across the top and bottom of the ceiling display and then a plurality of transverse runners extending between each of the upper and lower runners and dividing the suspended ceiling system into a grid pattern which is normally of a 2' by 4' size. A plurality of ceiling boards 6 with different designs on the faces thereof are positioned in the runner grid pattern. The runners and ceiling boards are suspended from the structural members of a building and normally this suspension is performed by the use of suspension wires 8 which are fastened to the steel beams of the roof of the building. The ceiling display is positioned about 7 to 14 feet above the floor of the building and the plane of the faces of the ceiling boards having the different designs thereon is inclined slightly from the vertical, often 45° from the vertical, so that someone standing on the floor of the building can look up at a slight upward angle and be then gazing almost directly on or perpendicular to the display of ceiling boards. This angle relationship provides a more comfortable viewing condition for the purchaser rather than having the ceiling boards actually suspended above the floor on a horizontal plane parallel with the floor. Also, this display can advantageously be used above an area which is used to store the ceiling boards which are boxed up and ready for sale.

A deficiency of the above arrangement of ceiling boards is that the display looks like a unitary planar surface of ceiling boards without any real clear line of demarcation between the different designs and without really providing a visual effect of what the particular design looks like by itself.

In order to improve the display of the ceiling boards, divider means 10 are fastened to the runners which separate the different ceiling board designs. The divider means has a body portion 12 which projects out perpendicularly from the planar surface of the ceiling boards. This then provides a positive barrier or line distinguishing one ceiling design from the next ceiling design. In addition, the divider means creates the impression of a wall so that when one is viewing a particular design, the divider means tend to more closely simulate a room effect and prevent the one board design from blending into the design of the adjacent boards and thus visually affecting the consumer's view of the individual designs. Finally, it has been noted that the use of the divider means yields produce "engagement," i.e., it attracts the attention of the consumers and draws them to the display.

The divider means is best shown in FIG. 2 wherein the divider means has a flange 14 and a body portion 16 which are actually an inverted T configuration. The flange 14 is normally provided with a strip of adhesive which can fasten the divider means 12 to a flange of a runner structure. Normally, this runner means is positioned between two adjacent boards of different designs. The divider means 12 in addition has a smaller flange 18 at the opposite end of the body 16 from flange 14. Both the large flange 14 and the smaller flange 18 have lips 20 which define recessed areas 22 between the lips 20 and the body portion 16. Into these lips on the large upper flange 14 and the smaller lower flange 18, there may be inserted some type of display means 24. This is basically nothing more than a piece of cardboard which will slide into the recesses 22 on both flanges 14 and 18. The cardboard may be provided with printed matter to identify the different ceiling designs.

Figure 1:
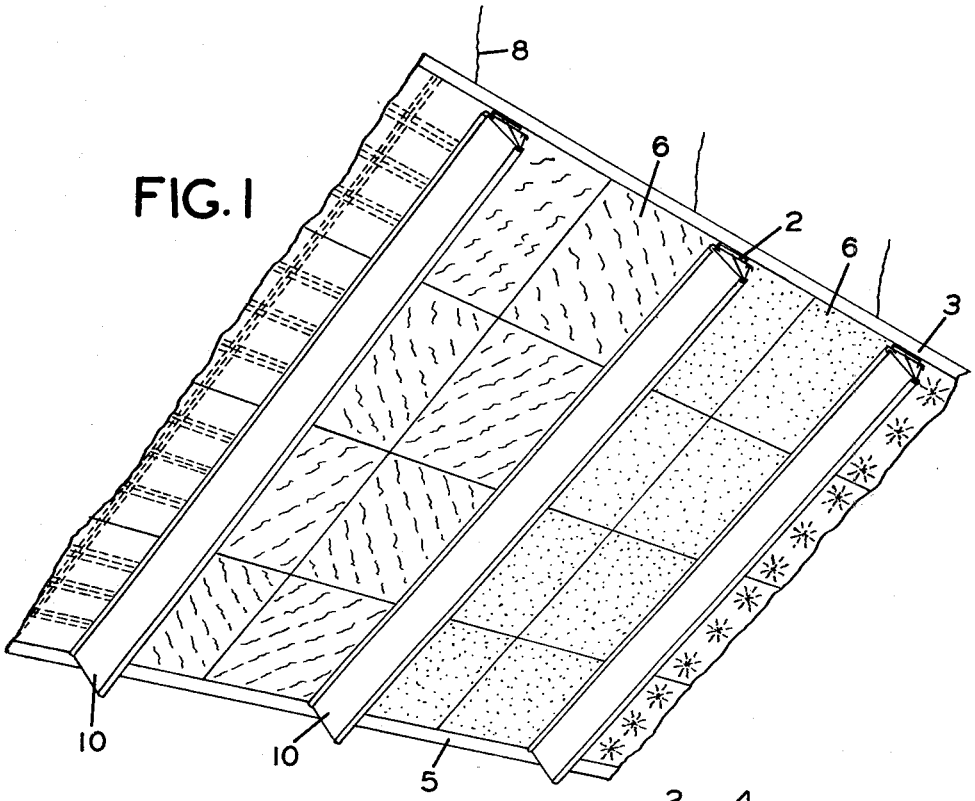
FIG. 1 is a perspective view of the invention in use.

The display of ceiling boards can be provided as a single planar display as shown in FIG. 1. There could be provided two sets of ceiling displays more or less back-to-back with both inclined and meeting at a common lower point. This forms a V-type display which will display some ceiling boards on one side of the V and other ceiling boards on the other side of the V. It is also possible to use a display such as shown in FIG. 1 and provided it on opposite sides of the same aisle area so that by walking down the aisle, one could look to either the right or left and see different ceiling designs on display. Any number of different ways can be utilized to take a single set of ceiling boards and use it alone or in combination with other sets of ceiling boards to display as many designs as one desires to display.

What is claimed is:

1. A ceiling display unit comprising:

(a) a plurality of T-shaped runner members formed into a grid pattern, said runners having flanges adapted to support ceiling boards, (b) a plurality of ceiling boards with different designs on the faces thereof positioned in the grid pattern of the runners, (c) said runners and ceiling boards being suspended from structural members of a building and being positioned about 7 to 14 feet above the floor of the building, the plane of the faces of the ceiling boards having the different designs being inclined slightly from the vertical so that the ceiling board faces can be viewed directly on by a person standing on the floor of the building; and (d) the improvement comprising (1) divider means positioned perpendicular to the plane of the faces of the ceiling boards, said divider means separating the different ceiling board designs one from the other.

2. A ceiling display unit as set forth in claim 1 wherein said divider means is positioned on the flanges of runners, said flanges being positioned in the plane of the faces of the ceiling designs and the runners which receive the divider means are those runners which are positioned between two different designs of ceiling boards.

3. A ceiling display unit as set forth in claim 1 wherein a second set of runners and boards are provided, the two sets of runners and boards being placed generally back-to-back in a V-shaped configuration.

4. A ceiling display unit as set forth in claim 1 wherein the divider means is of generally an inverted T-shape with the base of the T being fastened to a flange of a ceiling runner and the body of the inverted T extending perpendicular from the plane of the ceiling board faces.

5. A ceiling display unit as set forth in claim 4 wherein said divider means is a three-part structure having a large flange means which fastens to the flange of the runner structure, a small flange structure, and therebetween a body portion which is perpendicular to the plane of the ceiling boards, both said flanges having recesses which are adapted to receive display means mounted in the recesses on either side of the body portion of the divider means.

* * * * *